US009879577B2

(12) United States Patent
Yamaguchi et al.

(10) Patent No.: US 9,879,577 B2
(45) Date of Patent: Jan. 30, 2018

(54) VARIABLE VALVE MECHANISM OF INTERNAL COMBUSTION ENGINE

(71) Applicants: OTICS CORPORATION, Nishio-shi (JP); TOYOTA JIDOSHA KABUSHIKI KAISHA, Toyota-shi (JP)

(72) Inventors: Koki Yamaguchi, Nishio (JP); Naoki Hiramatsu, Nishio (JP); Takayuki Maezako, Nishio (JP); Masatoshi Sugiura, Nishio (JP); Shinichiro Kikuoka, Toyota (JP); Masaaki Tani, Toyota (JP); Motohiro Yuge, Toyota (JP)

(73) Assignees: OTICS CORPORATION, Nishio-Shi, Aichi-Ken (JP); TOYOTA JIDOSHA KABUSHIKI KAISHA, Toyota-Shi, Aichi-Ken (JP)

( * ) Notice: Subject to any disclaimer, the term of this patent is extended or adjusted under 35 U.S.C. 154(b) by 29 days.

(21) Appl. No.: 15/079,545

(22) Filed: Mar. 24, 2016

(65) Prior Publication Data

US 2016/0312669 A1 Oct. 27, 2016

(30) Foreign Application Priority Data

Apr. 23, 2015 (JP) ..... 2015-088822

(51) Int. Cl.
*F01L 1/34* (2006.01)
*F01L 13/00* (2006.01)
(Continued)

(52) U.S. Cl.
CPC ..... *F01L 13/0063* (2013.01); *F01L 13/0005* (2013.01); *F01L 1/053* (2013.01);
(Continued)

(58) Field of Classification Search
CPC ..... F01L 1/185; F01L 1/267; F01L 13/0005; F01L 13/0063; F01L 2013/001
(Continued)

(56) References Cited

U.S. PATENT DOCUMENTS 7,267,088 B2 * 9/2007 Ezaki ..... F01L 1/042 123/90.16

FOREIGN PATENT DOCUMENTS

JP 2001-263015 A 9/2001
JP 2006-112324 A 4/2006

OTHER PUBLICATIONS

Japanese Office Action dated Jan. 10, 2017 with a partial English translation thereof.

* cited by examiner

*Primary Examiner* — Ching Chang
(74) *Attorney, Agent, or Firm* — McGinn IP Law Group, PLLC

(57) ABSTRACT

A variable valve mechanism of an internal combustion engine includes a plurality of swing members and a variable device that displaces a control shaft to displace a plurality of slider gears of the swing members at a time, thereby changing valve lifts of the plurality of swing members at a time by meshing of helical splines. The swing members include a first swing member for a predetermined cylinder of a plurality of cylinders and a second swing member for a cylinder other than the predetermined cylinder, and a helix angle of the helical splines varies between the first and the second swing members. The variable device displaces the control shaft to a predetermined normal position to perform a normal operation, and displaces the control shaft to a predetermined cylinder cutoff position to perform a cylinder cutoff operation in which the second swing member does not drive a valve.

12 Claims, 12 Drawing Sheets

(51) Int. Cl.

| | |
|---|---|
| *F01L 1/053* | (2006.01) |
| *F01L 1/18* | (2006.01) |
| *F01L 1/24* | (2006.01) |
| *F01L 1/26* | (2006.01) |

(52) U.S. Cl.
CPC ..... *F01L 1/185* (2013.01); *F01L 1/2405* (2013.01); *F01L 1/267* (2013.01); *F01L 2013/001* (2013.01); *F01L 2013/105* (2013.01); *F01L 2013/106* (2013.01); *F01L 2105/00* (2013.01)

(58) Field of Classification Search
USPC ..... 123/90.16, 90.27, 90.31, 90.39, 90.44
See application file for complete search history.

TWO-STAGE SWITCHING

VARIABLE VALVE MECHANISM 1
(FIRST EMBODIMENT)
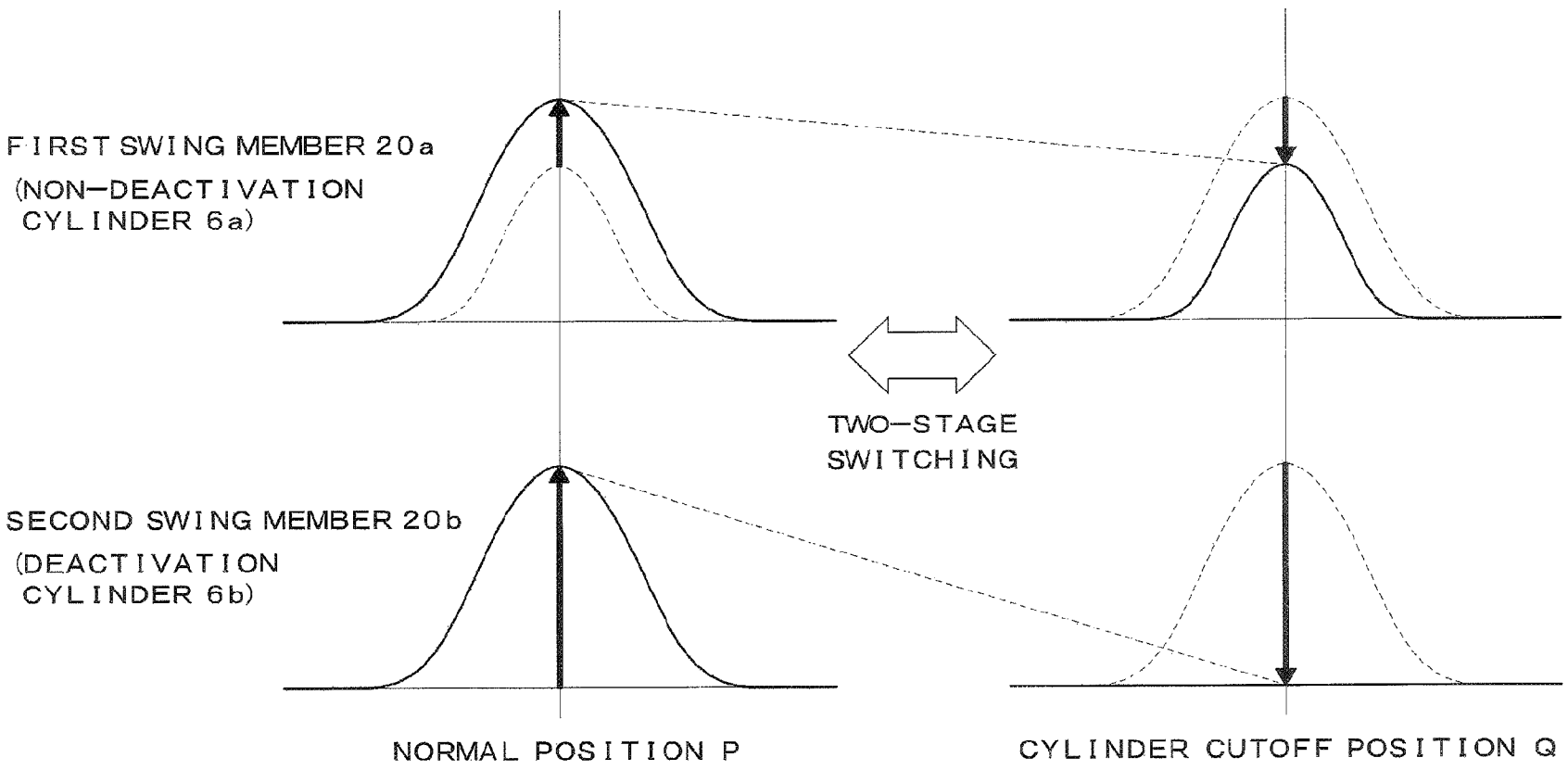

TWO-STAGE SWITCHING

VARIABLE VALVE MECHANISM 2
(SECOND EMBODIMENT)
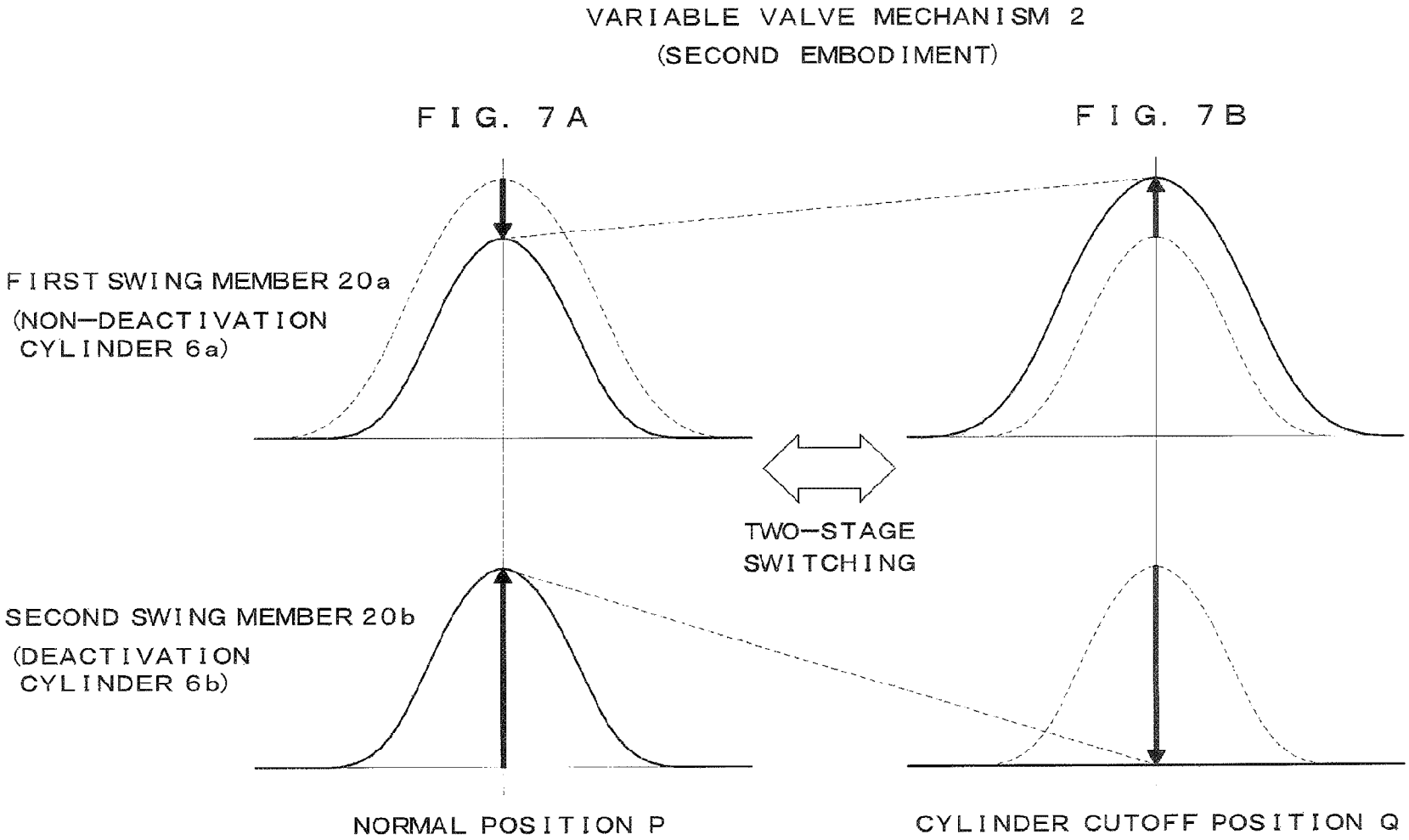

TWO-STAGE SWITCHING
CONTINUOUSLY VARIABLE
3
6a
6b
8
10
20a
20b
21
31
41
Ha
Hb
71
P
Q
(Q1)
(Q2)

VARIABLE VALVE MECHANISM 3
(THIRD EMBODIMENT)
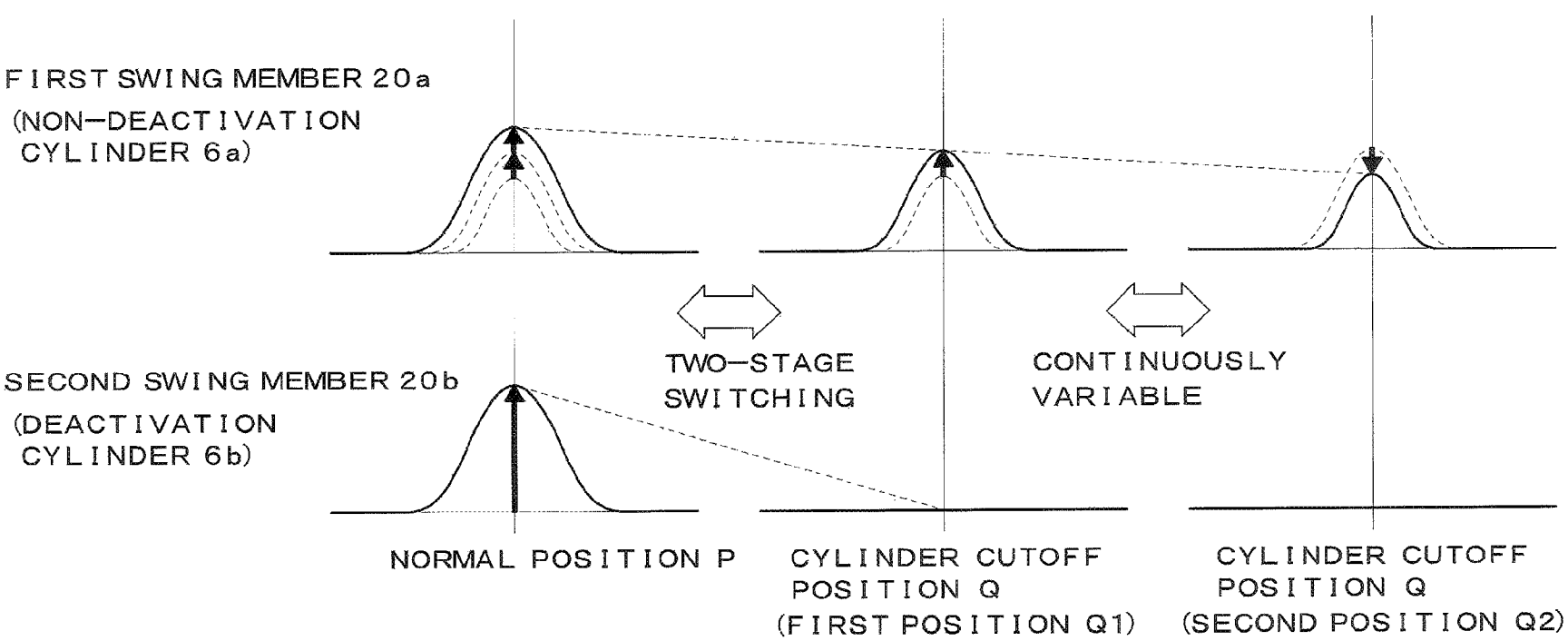

TWO-STAGE SWITCHING
CONTINUOUSLY VARIABLE
4
6a
6b
8
10
20a
20b
71
P
Q
(Q1)
(Q2)
Ha
Hb
21
31
41

VARIABLE VALVE MECHANISM 4
(FOURTH EMBODIMENT)
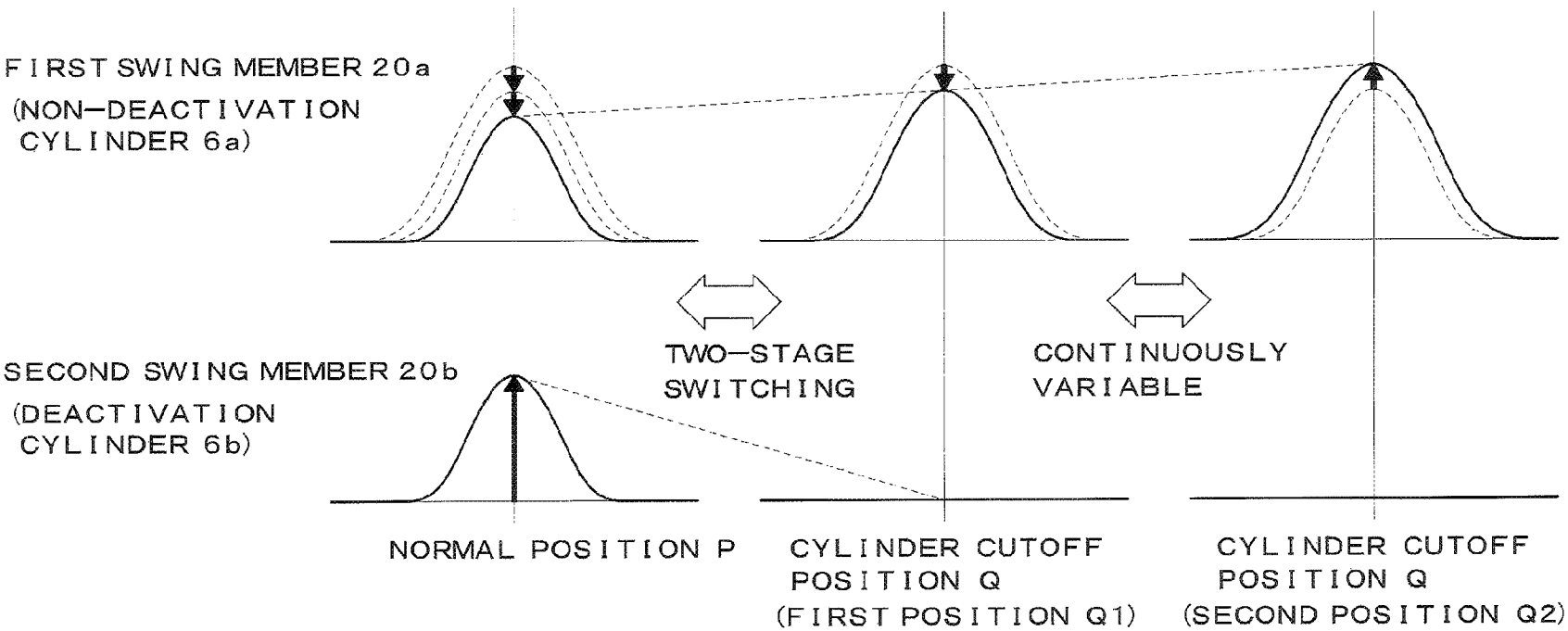

VARIABLE VALVE MECHANISM OF INTERNAL COMBUSTION ENGINE

TECHNICAL FIELD

The present invention relates to variable valve mechanisms that drive valves of an internal combustion engine and change the drive state of the valves according to the operating condition of the internal combustion engine.

BACKGROUND ART

An example of variable valve mechanisms of internal combustion engines is a variable valve mechanism 90 of a conventional example shown in FIG. 12 (Patent Document 1). The variable valve mechanism 90 is a mechanism that drives valves 8 of a plurality of cylinders 6 arranged side by side in a linear direction. The variable valve mechanism 90 includes a plurality of swing members 91 arranged side by side in the linear direction. Each swing member 91 includes an input member 92, output members 93, 93, and a slider gear 94 that meshes with the input member 92 and the output members 93, 93 via helical splines H. When the input member 92 is driven by a cam (not shown), the swing member 91 swings to drive the valves 8, 8 by the output members 93, 93.

This variable valve mechanism 90 further includes a variable device 97. The variable device 97 includes a control shaft 98. The control shaft 98 extends in the linear direction (the direction in which the swing members 91 are arranged side by side), and is displaced in the linear direction together with the plurality of slider gears 94. The variable device 97 displaces the control shaft 98 in the linear direction to displace the plurality of slider gears 94 at a time with respect to the plurality of input members 92 and the plurality of output members 93, thereby similarly changing the valve lifts of the plurality of swing members 91 at a time by meshing of the helical splines H.

CITATION LIST

Patent Document

[Patent Document 1] Japanese Patent Application Publication No. 2001-263015

SUMMARY OF INVENTION

Technical Problem

In this conventional example, the valve lifts of the plurality of swing members 91 are similarly changed at a time by displacing the plurality of slider gears 94 at a time by the control shaft 98. The variable valve mechanism of this conventional example therefore cannot be adapted to a cylinder cutoff operation in which apart of the cylinders 6 is deactivated so as not to drive the valves 8, 8.

It is an object of the present invention to adapt this type of variable valve mechanism to a cylinder cutoff operation.

Solution to Problem

In order to achieve the above object, a variable valve mechanism of an internal combustion engine according to the present invention includes: a plurality of swing members arranged side by side in a linear direction, each including an input member, an output member, and a slider gear that meshes with the input member and the output member via helical splines, and each swinging to drive a valve by the output member when the input member is driven by a cam; and a variable device that includes a control shaft extending in the linear direction and being displaced in the linear direction together with the plurality of slider gears, and that displaces the control shaft in the linear direction to displace the plurality of slider gears at a time with respect to the plurality of input members and the plurality of output members, thereby changing valve lifts of the plurality of swing members at a time by meshing of the helical splines. The swing members include a first swing member provided for a predetermined cylinder of a plurality of cylinders and a second swing member provided for a cylinder other than the predetermined cylinder of the plurality of cylinders. A helix angle of the helical splines varies between the first swing member and the second swing member. The variable device displaces the control shaft to a predetermined normal position to perform a normal operation in which both the first swing member and the second swing member drive the valve, and the variable device displaces the control shaft to a predetermined cylinder cutoff position to perform a cylinder cutoff operation in which the first swing member drives the valve and the second swing member does not drive the valve.

Advantageous Effects of Invention

According to the present invention, since the helix angle of the helical splines varies between the first swing member and the second swing member, the operation can be switched from the normal operation to the cylinder cutoff operation by displacing the control shaft. The variable valve mechanism of the present invention is therefore adapted to the cylinder cutoff operation.

BRIEF DESCRIPTION OF DRAWINGS

FIG. 5A is a graph showing a valve lift curve in the case where the control shaft of the variable valve mechanism of the first embodiment is located at the normal position, and FIG. 5B is a graph showing a valve lift curve in the case where the control shaft of the variable valve mechanism of the first embodiment is located at the cylinder cutoff position;

FIG. 7A is a graph showing a valve lift curve in the case where the control shaft of the variable valve mechanism of the second embodiment is located at the normal position, and FIG. 7B is a graph showing a valve lift curve in the case where the control shaft of the variable valve mechanism of the second embodiment is located at the cylinder cutoff position;

FIG. 9A is a graph showing a valve lift curve in the case where the control shaft of the variable valve mechanism of the third embodiment is located at the normal position, FIG. 9B is a graph showing a valve lift curve in the case where the control shaft of the variable valve mechanism of the third embodiment is located at the first position of the cylinder cutoff position, and FIG. 9C is a graph showing a valve lift curve in the case where the control shaft of the variable valve mechanism of the third embodiment is located at the second position of the cylinder cutoff position;

FIG. 11A is a graph showing a valve lift curve in the case where the control shaft of the variable valve mechanism of the fourth embodiment is located at the normal position, FIG. 11B is a graph showing a valve lift curve in the case where the control shaft of the variable valve mechanism of the fourth embodiment is located at the first position of the cylinder cutoff position, and FIG. 11C is a graph showing a valve lift curve in the case where the control shaft of the variable valve mechanism of the fourth embodiment is located at the second position of the cylinder cutoff position.

DESCRIPTION OF EMBODIMENTS

Figure 1:
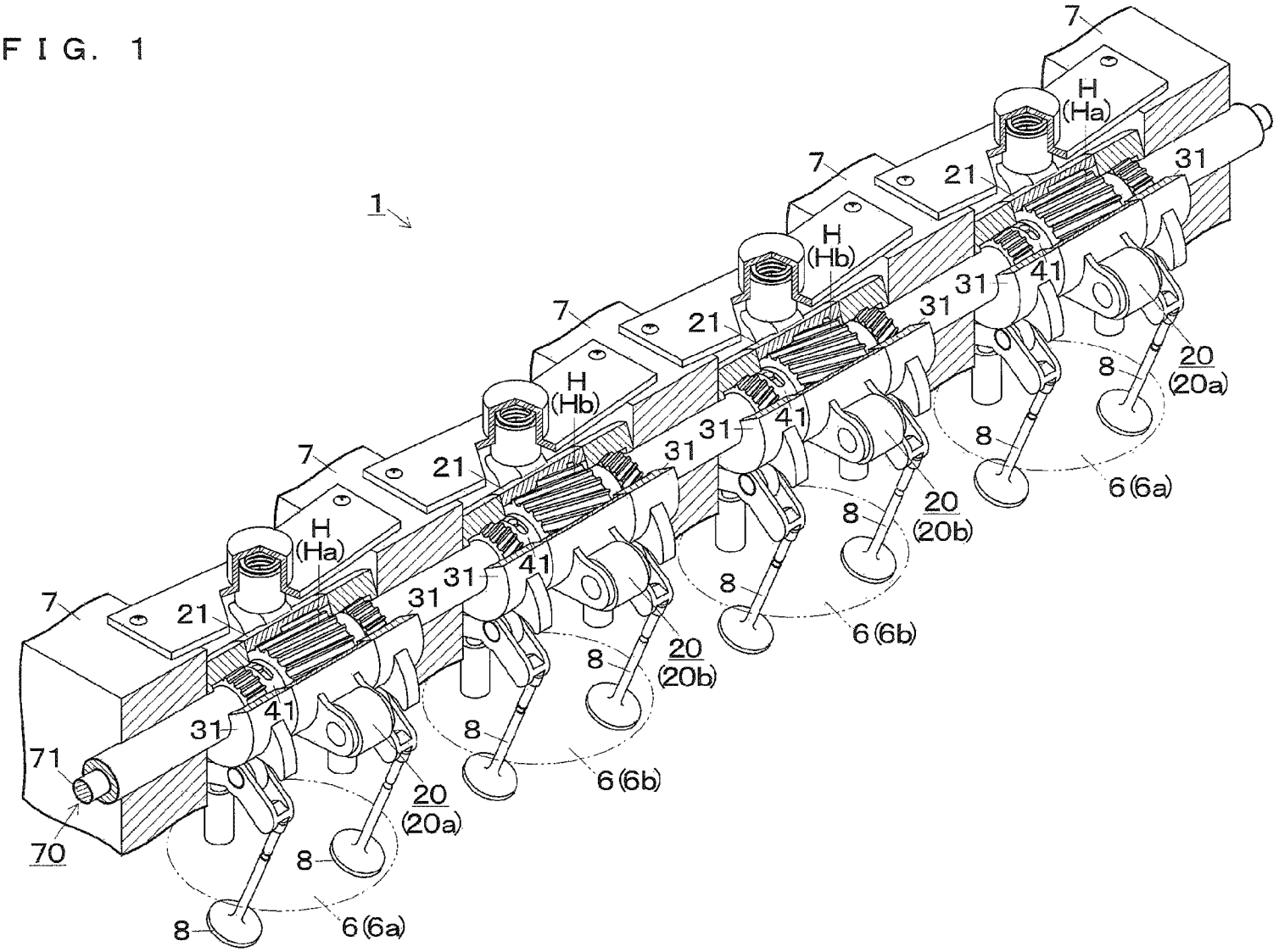
FIG. 1 is a general perspective view of a variable valve mechanism of a first embodiment.
Figure 2:
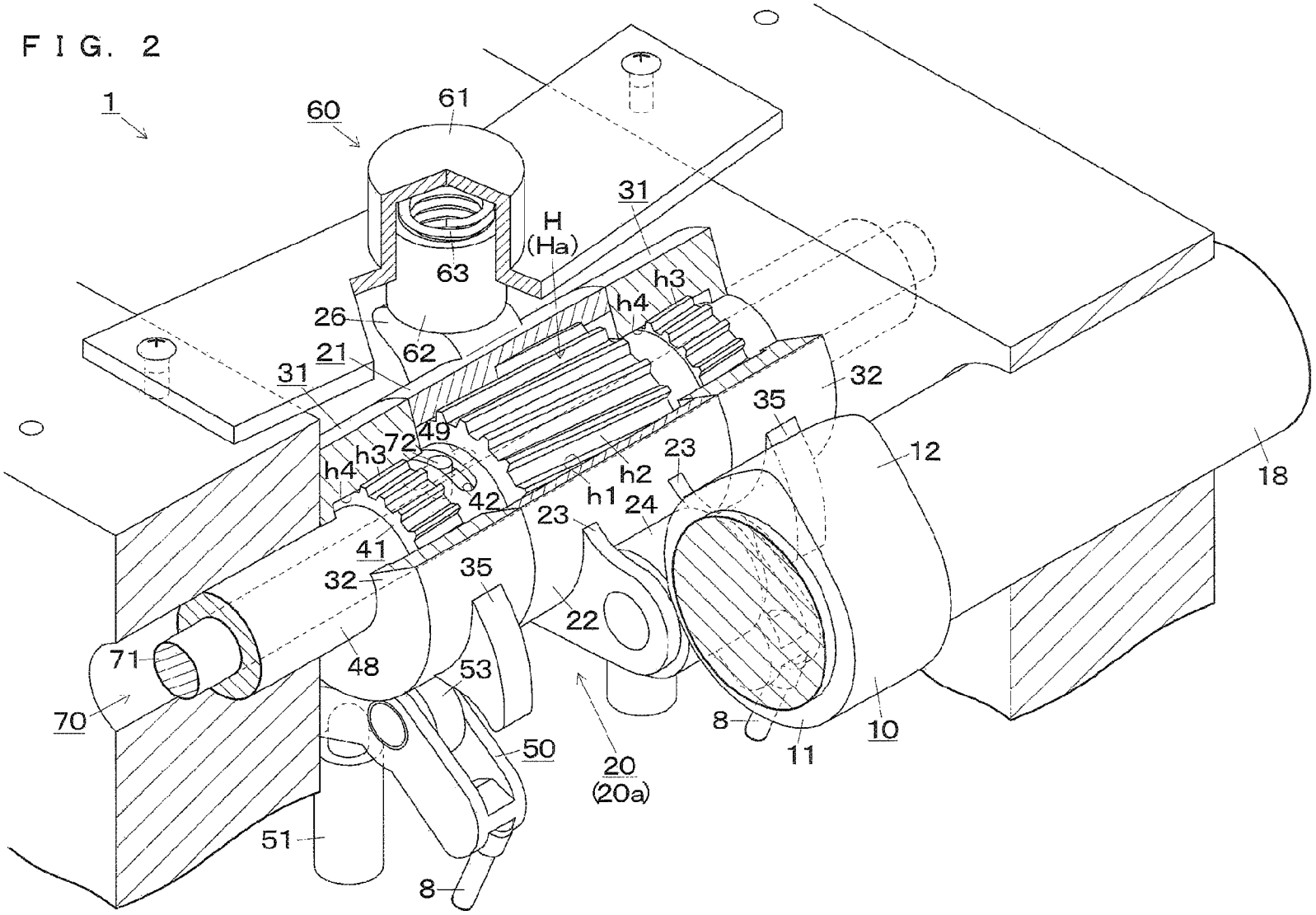
FIG. 2 is a perspective view of a first swing member of the variable valve mechanism of the first embodiment.
Figure 3:
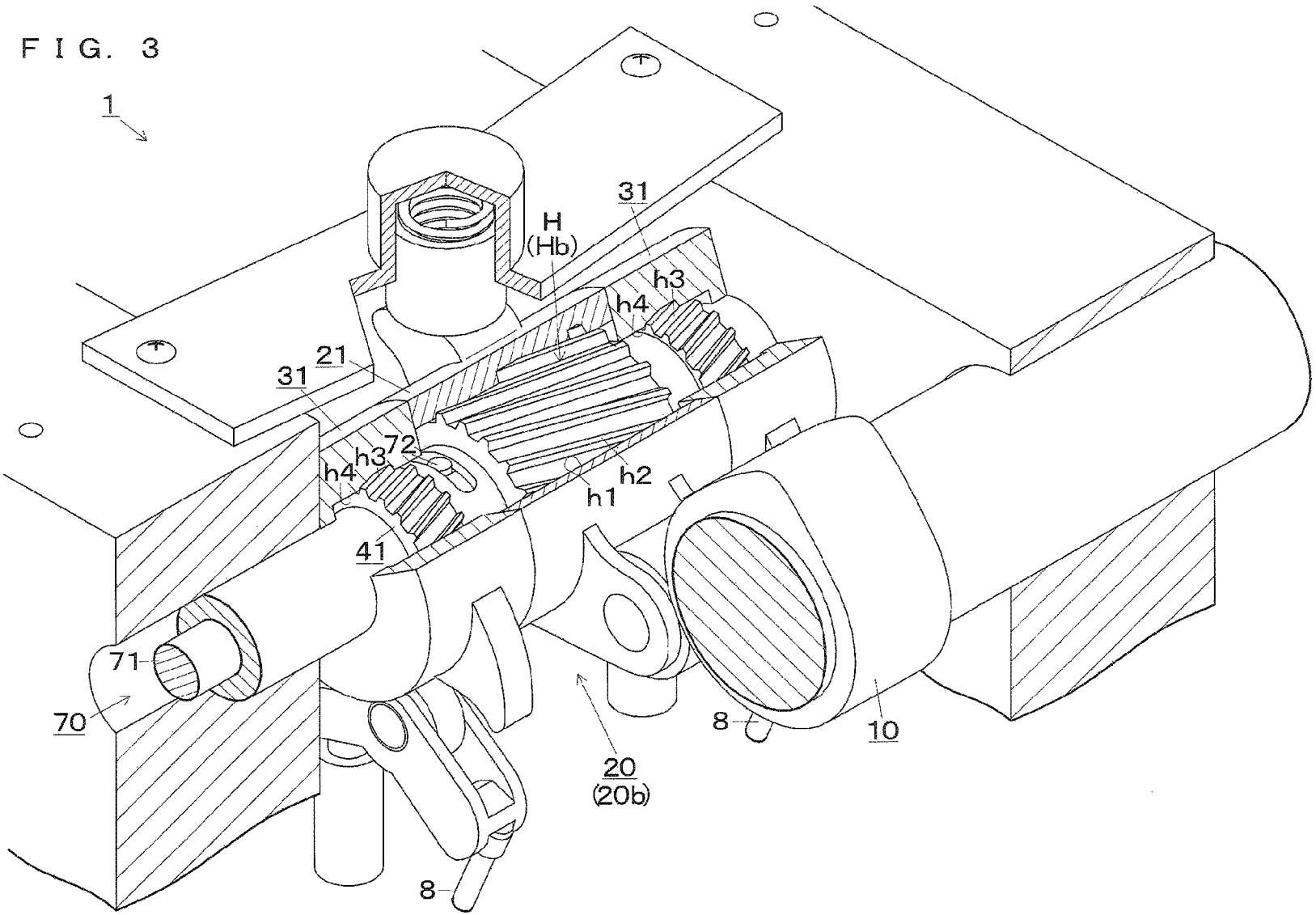
FIG. 3 is a perspective view of a second swing member of the variable valve mechanism of the first embodiment.

The first swing member may be in either the following form [1] or [2].

[1] The helical splines of the first swing member are formed at such a helix angle that the valve lift of the first swing member decreases when the control shaft is displaced from the normal position to the cylinder cutoff position.

[2] The helical splines of the first swing member are formed at such a helix angle that the valve lift of the first swing member increases when the control shaft is displaced from the normal position to the cylinder cutoff position.

That is, the first form is applied to internal combustion engines having such characteristics that are more advantageous if the valve lift of the first swing member decreases when the operation is switched from the normal operation to the cylinder cutoff operation, and the second form is applied to internal combustion engines having such characteristics that are more advantageous if the valve lift of the first swing member increases when the operation is switched from the normal operation to the cylinder cutoff operation. The characteristics of the internal combustion engines can thus be more advantageously implemented as compared to the case where the valve lift of the first swing member is not changed and the second swing member is merely deactivated so as not to drive the valve.

The variable device may merely displace the control shaft from the normal position to the cylinder cutoff position and from the cylinder cutoff position to the normal position. The variable device may further displace the control shaft as follows. The variable device may displace the control shaft within the cylinder cutoff position to increase or decrease the valve lift of the first swing member while maintaining the cylinder cutoff operation. In this case, the valve lift can be increased or decreased as necessary during the cylinder cutoff operation.

First Embodiment

A variable valve mechanism 1 of a first embodiment shown in FIGS. 1 to 5B is a mechanism that drives valves 8 of a plurality of cylinders 6 arranged side by side in a linear direction. In the following description, the "linear direction" is referred to as the "thrust direction," one side in the longitudinal direction of a straight line perpendicular to the thrust direction is referred to as "front" or "forward" and the other side in the longitudinal direction of the straight line is referred to as "rear" or "rearward."

The variable valve mechanism 1 includes a plurality of swing members 20 arranged side by side in the thrust direction. Each swing member 20 includes an input member 21, output members 31, 31, and a slider gear 41 that meshes with the input member 21 and the output members 31, 31 via helical splines H. When the input member 21 is driven by a cam 10, the swing member 20 swings to drive the valves 8, 8 by the output members 31, 31.

This variable valve mechanism 1 further includes a variable device 70. The variable device 70 includes a control shaft 71. The control shaft 71 extends in the thrust direction, and is displaced in the thrust direction together with the plurality of slider gears 41. The variable device 70 displaces the control shaft 71 in the thrust direction to displace the plurality of slider gears 41 at a time with respect to the plurality of input members 21 and the plurality of output members 31, thereby changing the valve lifts of the plurality of swing members 20 at a time by meshing of the helical splines H.

The swing members 20 include first swing members 20*a*, 20*a* that are provided for predetermined cylinders (hereinafter referred to as the "non-deactivation cylinders 6*a*, 6*a*") of the plurality of cylinders 6, and second swing members 20*b*, 20*b* that are provided for cylinders other than the predetermined cylinders (hereinafter referred to as the "deactivation cylinders 6*b*, 6*b*") of the plurality of cylinders 6. The first swing members 20*a*, 20*a* are different from the second swing members 20*b*, 20*b* in the helix angle of the helical splines H (Ha, Hb).

Figure 4B:
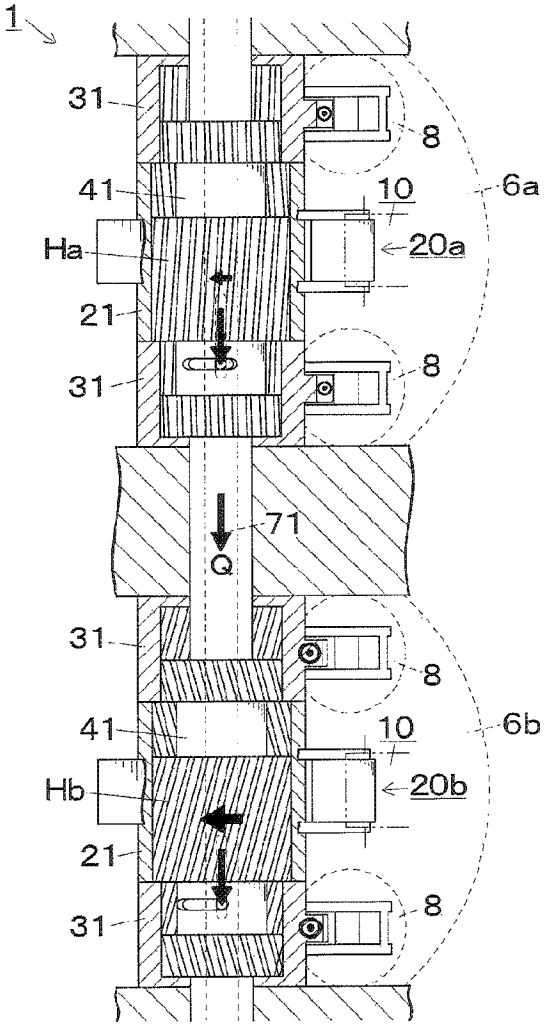
FIG. 4B is a sectional plan view showing the case where the control shaft of the variable valve mechanism of the first embodiment is located at a cylinder cutoff position.
Figure 4A:
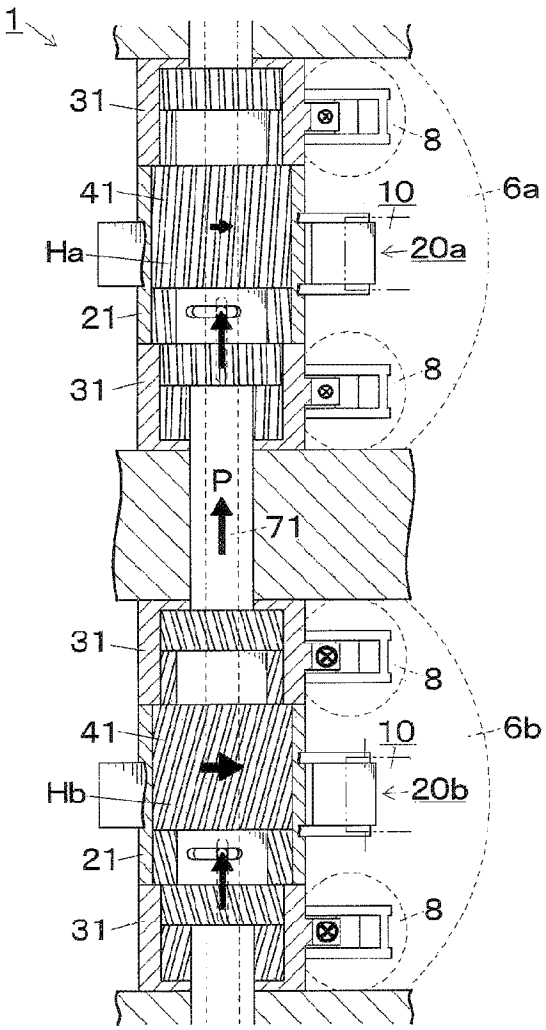
FIG. 4A is a sectional plan view showing the case where a control shaft of the variable valve mechanism of the first embodiment is located at a normal position.

As shown in FIG. 4A, the variable device 70 displaces the control shaft 71 to a predetermined normal position P located on one side in the thrust direction to perform a normal operation in which both the first swing members 20*a*, 20*a* and the second swing members 20*b*, 20*b* drive the valves 8 as shown in FIG. 5A. As shown in FIG. 4B, the variable device 70 displaces the control shaft 71 to a predetermined cylinder cutoff position Q located on the other side in the thrust direction to perform a cylinder cutoff operation in which the first swing members 20*a*, 20*a* drive the valves 8 and the second swing members 20*b*, 20*b* do not drive the valves 8 as shown in FIG. 5B.

Specifically, this variable valve mechanism includes the cams 10, the swing members 20, rocker arms 50, lost motion mechanisms 60, and the variable device 70, as described below.

[Cam 10]

The cams 10 are provided on a cam shaft 18 extending in the thrust direction. One cam 10 is provided for each cylinder 6. The cam shaft 18 rotates according to rotation of an internal combustion engine, and the cams 10 also rotate together with the cam shaft 18. Each cam 10 includes a base circle portion 11 having a circular section, and a nose 12 protruding from the base circle portion 11.

[Swing Member 20]

One swing member 20 is provided for each cylinder 6, and all the swing members 20 are supported by a single support shaft 48 extending in the thrust direction. The support shaft 48 is a pipe-shaped shaft that extends through a plurality of standing walls 7. The plurality of standing walls 7 are arranged side by side in the thrust direction in a cylinder head of the internal combustion engine so as to protrude from the cylinder head. Each part of the support shaft 48 which is located between two of the standing walls 7 supports one swing member 20. Each of the parts of the support shaft 48 which support the swing members 20 has an insertion hole 49 extending in the thrust direction.

Each swing member 20 includes one input member 21, two output members 31, 31 provided on both sides of the input member 21 in the thrust direction, and one slider gear 41 fitted in the input member 21 and the two output members 31, 31. Displacement of the input member 21 and the output members 31, 31 in the thrust direction is restricted as an end face on one side in the thrust direction of one output member 31 that is located on the one side in the thrust direction of the input member 21 and an end face on the other side in the thrust direction of the other output member 31 that is located on the other side in the thrust direction of the input member 21 contact, either directly or with a shim (not shown) interposed therebetween, the standing walls 7, 7 that are located on both sides in the thrust direction of the swing member 20.

Each input member 21 includes a tubular portion 22, a pair of arms 23, 23, and a protrusion 26. The tubular portion 22 has the shape of a tube. The pair of arms 23, 23 are provided at two positions on the tubular portion 22 which are separated from each other in the thrust direction, and protrude forward from the tubular portion 22. The protrusion 26 protrudes rearward from the tubular portion 22. A roller 24 that contacts the cam 10 is rotatably supported between the front ends of the pair of arms 23, 23.

Each input member 20 has helical splines h1 on the inner peripheral surface of the tubular portion 22. The helical splines h1 are twisted in one direction (twisted to slant to one side in the circumferential direction closer to one side in the thrust direction). The helix angle of the helical splines h1 varies between the first swing member 20*a* and the second swing member 20*b*. The helix angle of the helical splines h1 of the input member 21 of the second swing member 20*b* is larger than that of the helical splines h1 of the input member 21 of the first swing member 20*a*.

Each output member 31 includes a tubular portion 32 having the shape of a tube, and a nose 35 protruding forward from the tubular portion 32. Each output member 31 has pressing surfaces in the lower surfaces of the tubular portion 32 and the nose 35 in order to lift the valve 8.

Each output member 31 has helical splines h4 on the inner peripheral surface of the tubular portion 32. The helical splines h4 are twisted in the other direction opposite to the one direction (twisted to slant to the other side in the circumferential direction closer to the one side in the thrust direction). The helix angle of the helical splines h4 varies between the first swing member 20*a* and the second swing member 20*b*. The helix angle of the helical splines h4, h4 of the output members 31, 31 of the second swing member 20*b* is larger than that of the helical splines h4, h4 of the output members 31, 31 of the first swing member 20*a*.

Each slider gear 41 has the shape of a tube, and has an engagement hole 42 extending in the circumferential direction. Each slider gear 41 has input-side helical splines h2 and output-side helical splines h3, h3 on its outer peripheral surface. The input-side helical splines h2 mesh with the helical splines h1 of the input member 21, and the output-side helical splines h3, h3 mesh with the helical splines h4, h4 of the output members 31, 31.

The input-side helical splines h2 are thus twisted in the one direction like the helical splines h1 of the input member 21, and the helix angle of the input-side helical splines h2 varies between the first swing member 20*a* and the second swing member 20*b* like the helical splines h1 of the input member 21. The output-side helical splines h3, h3 are twisted in the other direction like the helical splines h4, h4 of the output members 31, 31, and the helix angle of the output-side helical splines h3, h3 varies between the first swing member 20*a* and the second swing member 20*b* like the helical splines h4, h4 of the output member 31, 31.

The helical splines H of the swing member 20 are comprised of the helical splines h1 of the input member 21, the input-side helical splines h2 and the output-side helical splines h3, h3 of the slider gear 41, and the helical splines h4, h4 of the output members 31, 31. In the following description, "Ha" refers to the helical splines H of the first swing member 20*a*, and "Hb" refers to the helical splines H of the second swing member 20*b*.

The difference in helix angle between the helical splines Ha of the first swing member 20*a* and the helical splines Hb of the second swing member 20*b* functions as follows . When the control shaft 71 is displaced to the predetermined normal position P located on one side in the thrust direction as shown in FIG. 4A, the first swing member 20*a* and the second swing member 20*b* have the same valve lift curve as shown in FIG. 5A. When the control shaft 71 is displaced from the normal position P to the predetermined cylinder cutoff position Q located on the other side in the thrust direction as shown in FIG. 4B, the valve lift of the first swing member 20*a* decreases relatively gently according to the displacement of the control shaft 71, and the valve lift of the second swing member 20*b* relatively rapidly decreases to zero according to the displacement of the control shaft 71, as shown in FIG. 5B.

[Rocker Arm 50]

One rocker arm 50 is provided between each output member 31 and a corresponding one of the valves 8. Each rocker arm 50 is supported at its rear end by a lash adjuster 51, and rotatably supports a roller 53 in its intermediate part in the longitudinal direction. The front end of each rocker arm 50 contacts the valve 8. The roller 53 contacts the pressing surfaces of the tubular portion 32 and the nose 35 of the output member 31.

[Lost Motion Mechanism 60]

The lost motion mechanisms 60 are mechanisms that bias the swing members 20 in a return direction (the direction opposite to the direction in which the valves 8 are lifted).

Each lost motion mechanism 60 includes a tubular body 61, a lifter 62, and a spring 63. The body 61 opens downward. The upper part of the lifter 62 is inserted in the body 61, and the lower surface of the lifter 62 contacts the protrusion 26 of the input member 21. The spring 63 is interposed between the body 61 and the lifter 62.

[Variable Device 70]

The variable device 70 includes the control shaft 71 and a displacement device (not shown).

The control shaft 71 passes through the pipe-shaped support shaft 48, and engagement pins 72 are attached to the control shaft 71 so as to protrude in the radial direction. One engagement pin 72 is provided for each swing member 20. The engagement pins 72 pass through the insertion holes 49 of the support shaft 48 and engage with the engagement holes 42 of the slider gears 41. All of the slider gears 41 thus engage with the control shaft 71 so that the slider gears 41 can be displaced in the thrust direction together with the control shaft 71 and can be rotated relative to the control shaft 71 in the circumferential direction.

The displacement device (not shown) is a device that displaces the control shaft 71 in the thrust direction. For example, the displacement device may be an electromagnetic displacement device that displaces the control shaft 71 in the thrust direction by an electromagnetic force, a hydraulic displacement device that displaces the control shaft 71 by an oil pressure, or a pneumatic displacement device that displaces the control shaft 71 by an air pressure. This displacement device displaces the control shaft 71 only in two stages, namely between the normal position P shown in FIGS. 4A and 5A and the cylinder cutoff position Q shown in FIGS. 4B and 5B.

Structurally, it is possible to stop the control shaft 71 at an intermediate position between the two stages. However, since it is not very preferable that the first swing member 20*a* and the second swing member 20*b* drive the valves 8 according to different valve lift curves. The control shaft 71 is therefore made to pass the intermediate position as quickly as possible. The control shaft 71 is not actively stopped at the intermediate position.

The first embodiment has the following effects A and B.

[A] Since the helix angle of the helical splines H (Ha, Hb) varies between the first swing member 20*a* and the second swing member 20*b*, the normal operation can be performed by displacing the control shaft 71 to the normal position P, and the cylinder cutoff operation can be performed by displacing the control shaft 71 to the cylinder cutoff position Q. The operation can thus be switched between the normal operation and the cylinder cutoff operation as necessary, which leads to improved fuel economy.

[B] The valve lift of the first swing member 20*a* decreases when the control shaft 71 is displaced from the normal position P to the cylinder cutoff position Q. Accordingly, by applying the variable valve mechanism 1 of the first embodiment to internal combustion engines having such characteristics that are more advantageous if the valve lift of the first swing members 20*a*, 20*a* decreases when the operation is switched from the normal operation to the cylinder cutoff operation, the characteristics of the internal combustion engines can be more advantageously implemented as compared to the case where the valve lift of the first swing members 20*a*, 20*a* is not changed and the second swing members 20*b*, 20*b* are merely deactivated so as not to drive the valves 8 (the case where the number of cylinders that drive the valves is reduced).

Second Embodiment

The structure of a variable valve mechanism 2 of a second embodiment shown in FIGS. 6A to 7B is different from that of the variable valve mechanism 1 of the first embodiment in that the helix angle of the helical splines Ha of the first swing member 20*a* is opposite to that of the helical splines Ha of the first swing member 20*a* in the first embodiment. The structure of the variable valve mechanism 2 is otherwise similar to that of the variable valve mechanism 1.

The helical splines h1 of the input member 21 and the input-side helical splines h2 of the slider gear 41 of the first swing member 20*a* of the second embodiment are twisted in the other direction, namely in the opposite direction to that of the first embodiment. The output-side helical splines h3, h3 of the slider gear 41 and the helical splines h4, h4 of the output members 31, 31 of the first swing member 20*a* of the second embodiment are twisted in the one direction, namely in the opposite direction to that of the first embodiment.

Figure 6B:
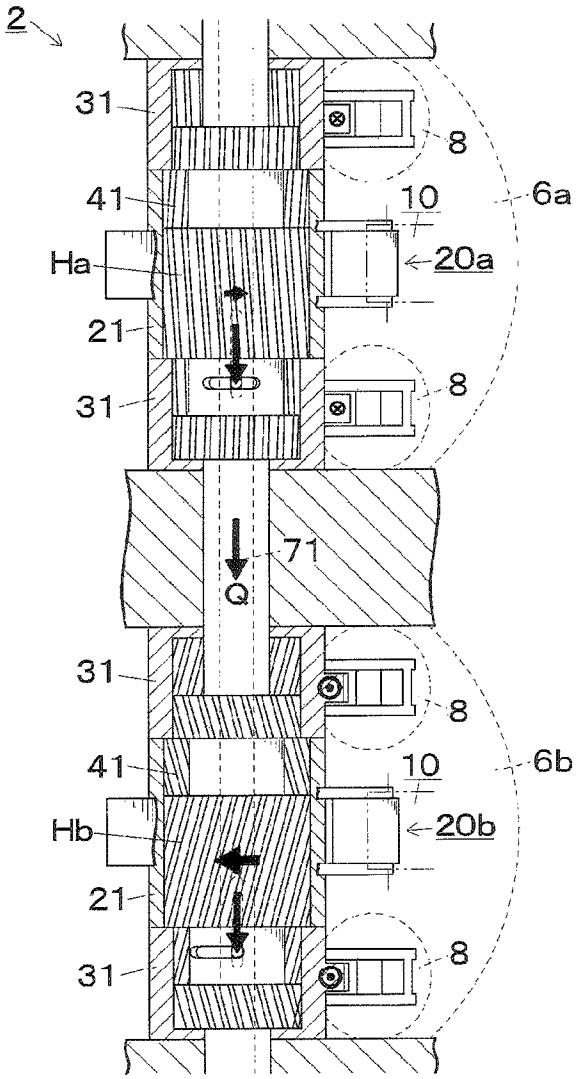
FIG. 6B is a sectional plan view showing the case where the control shaft of the variable valve mechanism of the second embodiment is located at a cylinder cutoff position.
Figure 6A:
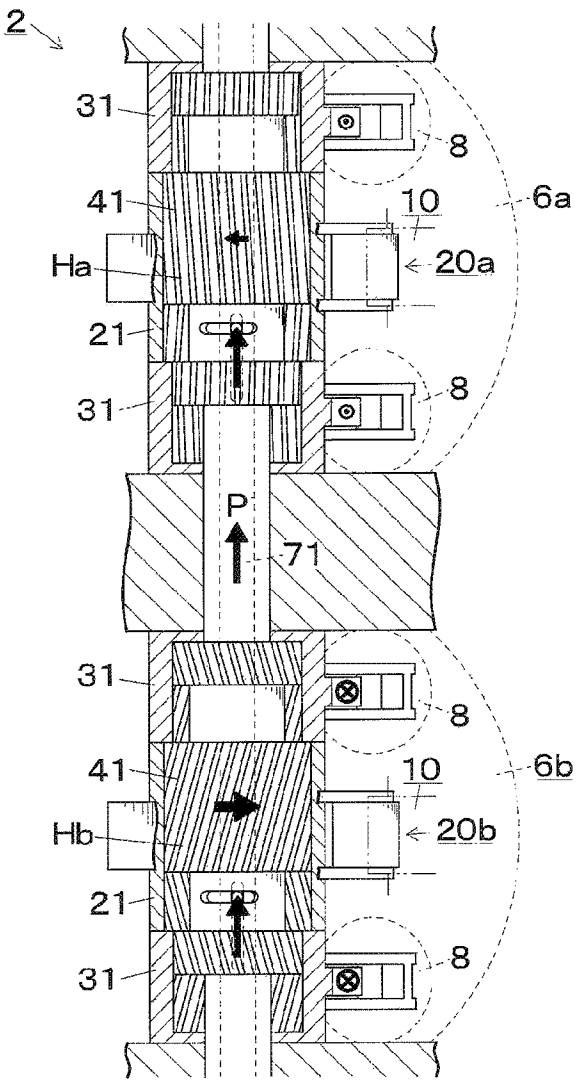
FIG. 6A is a sectional plan view showing the case where a control shaft of a variable valve mechanism of a second embodiment is located at a normal position.

The difference in helix angle between the helical splines Ha of the first swing member 20*a* and the helical splines Hb of the second swing member 20*b* functions as follows . When the control shaft 71 is displaced to the predetermined normal position P located on one side in the thrust direction as shown in FIG. 6A, the first swing member 20*a* and the second swing member 20*b* have the same valve lift curve as shown in FIG. 7A. When the control shaft 71 is displaced from the normal position P to the predetermined cylinder cutoff position Q located on the other side in the thrust direction as shown in FIG. 6B, the valve lift of the first swing member 20*a* increases relatively gently, and the valve lift of the second swing member 20*b* relatively rapidly decreases to zero, as shown in FIG. 7B.

The second embodiment has the following effect B' in addition to the effect A of the first embodiment.

[B'] The valve lift of the first swing member 20*a* increases when the control shaft 71 is displaced from the normal position P to the cylinder cutoff position Q. Accordingly, by applying the variable valve mechanism 2 of the second embodiment to internal combustion engines having such characteristics that are more advantageous if the valve lift of the first swing members 20*a*, 20*a* increases when the operation is switched from the normal operation to the cylinder cutoff operation, the characteristics of the internal combustion engines can be more advantageously implemented as compared to the case where the valve lift of the first swing members 20*a*, 20*a* is not changed and the second swing members 20*b*, 20*b* are merely deactivated so as not to drive the valves 8 (the case where the number of cylinders that drive the valves is reduced).

Third Embodiment

A variable valve mechanism 3 of a third embodiment shown in FIGS. 8A to 9C is different from the variable valve mechanism 1 of the first embodiment in that the variable device 70 not only displaces the control shaft 71 in two stages, namely between the normal position P and the cylinder cutoff position Q, but also displaces the control shaft 71 within the cylinder cutoff position Q to increase or decrease the valve lift of the first swing members 20*a*, 20*a* continuously or in multiple stages while maintaining the cylinder cutoff operation. The variable valve mechanism 3 of the third embodiment is otherwise similar to the variable valve mechanism 1 of the first embodiment.

Figures 8A, 8B, 8C:
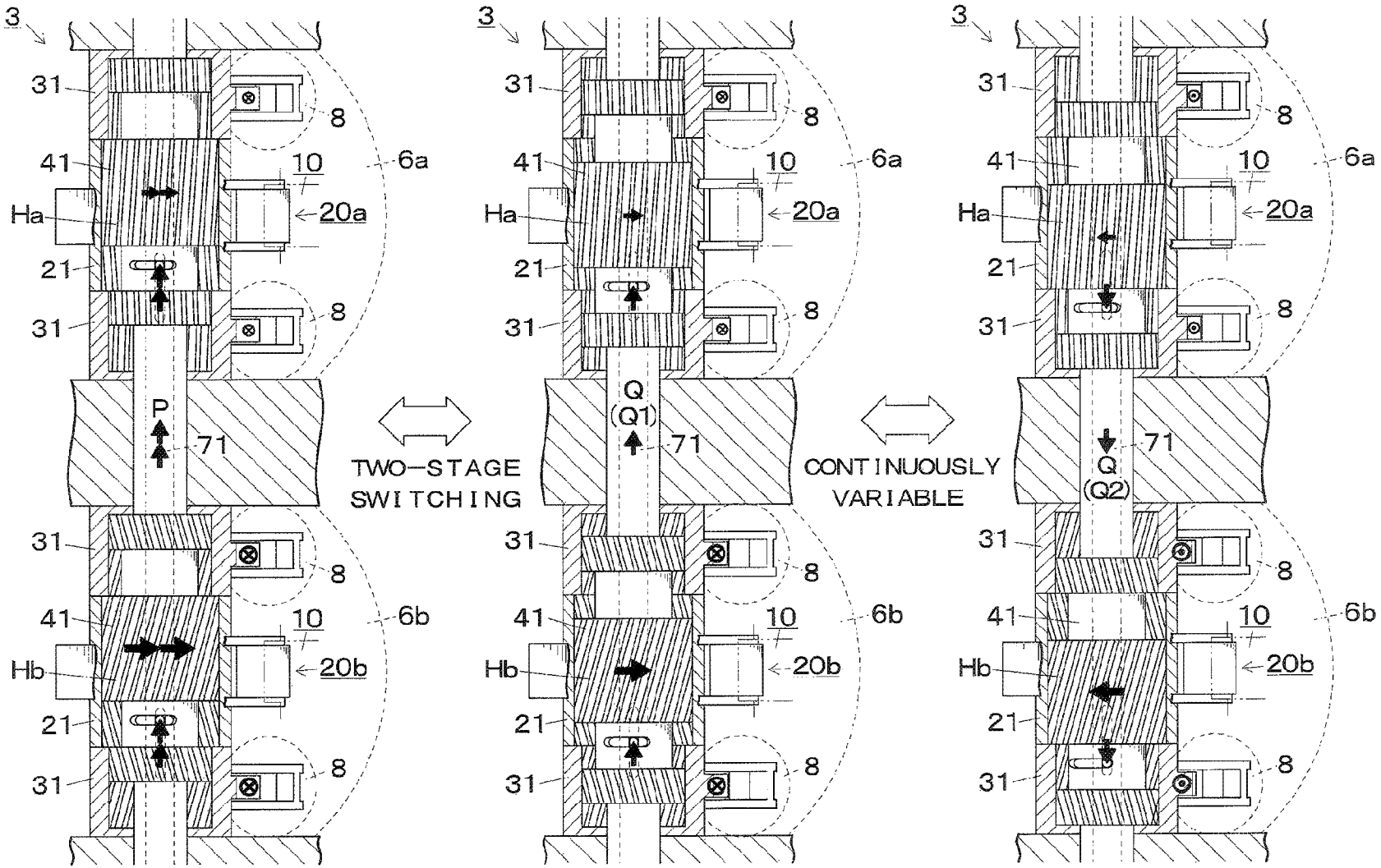
FIG. 8A is a sectional plan view showing the case where a control shaft of a variable valve mechanism of a third embodiment is located at a normal position.
FIG. 8B is a sectional plan view showing the case where the control shaft of the variable valve mechanism of the third embodiment is located at a first position of a cylinder cutoff position.
FIG. 8C is a sectional plan view showing the case where the control shaft of the variable valve mechanism of the third embodiment is located at a second position of the cylinder cutoff position.

Specifically, the difference in helix angle between the helical splines Ha of the first swing member 20*a* and the helical splines Hb of the second swing member 20*b* functions as follows. When the control shaft 71 is displaced to a predetermined first position Q1, a position located on one side (the normal position P side) in the thrust direction as shown in FIG. 8B, within the cylinder cutoff position Q shown in FIGS. 8B and 8C, the valve lift of the first swing members 20*a*, 20*a* increases as shown in FIG. 9B. At this time, the valve lift of the second swing members 20*b*, 20*b* remains at zero. When the control shaft 71 is displaced to a predetermined second position Q2, a position located on the other side (the opposite side from the normal position P side) in the thrust direction as shown in FIG. 8C, within the cylinder cutoff position Q shown in FIGS. 8B and 8C, the valve lift of the first swing members 20*a*, 20*a* decreases as shown in FIG. 9C. The valve lift of the second swing members 20*b*, 20*b* remains at zero at this time as well.

The second swing members 20*b*, 20*b* thus do not drive the valves 8 during the cylinder cutoff operation. Since there is no possibility that the first swing members 20*a*, 20*a* and the second swing members 20*b*, 20*b* drive the valves 8 according to different valve lift curves during the cylinder cutoff operation, the control shaft 71 can be stopped at any position within the cylinder cutoff position Q in addition to the first position Q1 and the second position Q2. The valve lift of the first swing members 20*a*, 20*a* can thus be increased or decreased continuously or in multiple stages during the cylinder cutoff operation.

The third embodiment has the following effect C in addition to the effects A and B of the first embodiment.

[C] The valve lift can be increased or decreased either continuously or in multiple stages as necessary during the cylinder cutoff operation, which leads to further improved fuel economy.

Fourth Embodiment

A variable valve mechanism 4 of a fourth embodiment shown in FIGS. 10A to 11C is different from the variable valve mechanism 2 of the second embodiment in that the variable device 70 not only displaces the control shaft 71 in two stages, namely between the normal position P and the cylinder cutoff position Q, but also displaces the control shaft 71 within the cylinder cutoff position Q to increase or decrease the valve lift of the first swing members 20*a*, 20*a* continuously or in multiple stages while maintaining the cylinder cutoff operation. The variable valve mechanism 4 of the fourth embodiment is otherwise similar to the variable valve mechanism 2 of the second embodiment.

Figures 10A, 10B, 10C:
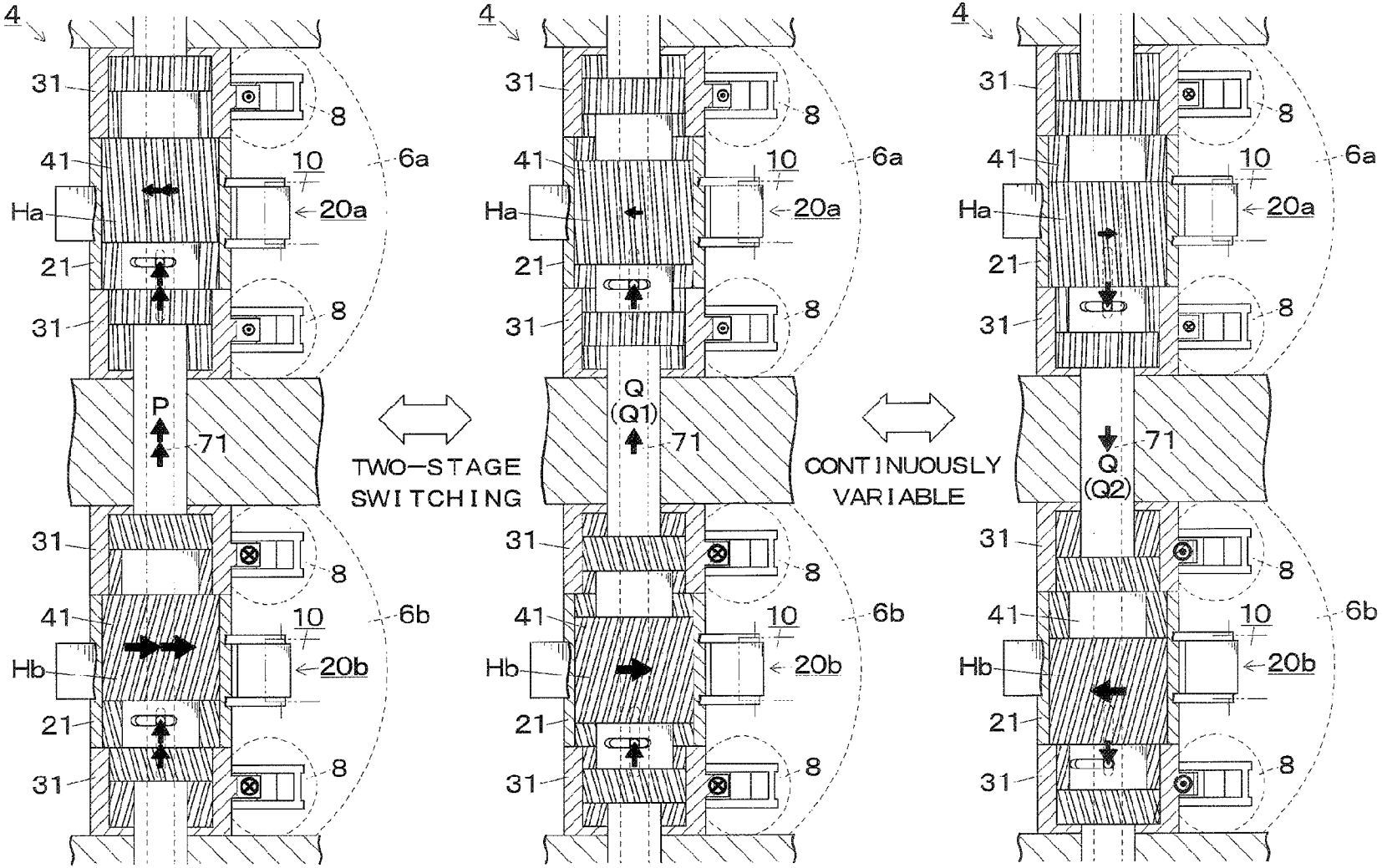
FIG. 10A is a sectional plan view showing the case where a control shaft of a variable valve mechanism of a fourth embodiment is located at a normal position.
FIG. 10B is a sectional plan view showing the case where the control shaft of the variable valve mechanism of the fourth embodiment is located at a first position of a cylinder cutoff position.
FIG. 10C is a sectional plan view showing the case where the control shaft of the variable valve mechanism of the fourth embodiment is located at a second position of the cylinder cutoff position.
Figure 12:
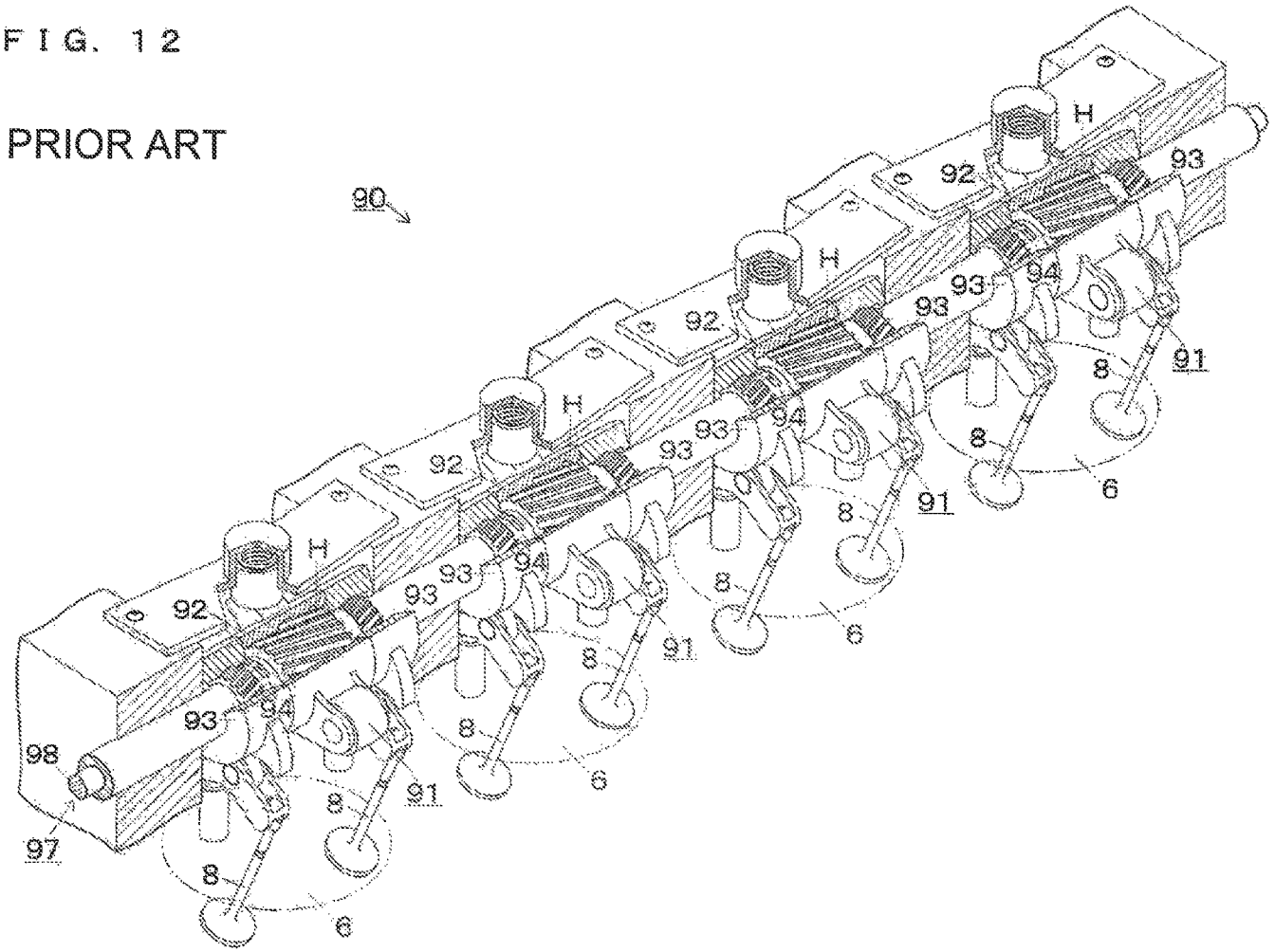
FIG. 12 PRIOR ART
FIG. 12 is a general perspective view of a variable valve mechanism of a conventional example.

Specifically, the same description as that in the third embodiment applies to the fourth embodiment except that "FIGS. 8A to 8C" in the description of the third embodiment are replaced with "FIGS. 10A to 10C," "FIGS. 9A to 9C" are replaced with "FIGS. 11A to 11C," "the third embodiment" is replaced with "the fourth embodiment," "the variable valve mechanism 3" is replaced with "the variable valve mechanism 4," "the first embodiment" is replaced with "the second embodiment," "increase" is replaced with "decrease," "decrease" is replaced with "increase," and "B" is replaced with "B'."

The present invention is not limited to the configurations of the first to fourth embodiments, and may be modified as appropriate without departing from the spirit and scope of the invention. For example, the present invention may be modified like the following modifications.

First Modification

In FIG. 1, the first swing members 20*a* are provided for two of four cylinders which are located at both ends, and the second swing members 20*b* are provided for the remaining two cylinders. However, the first swing member 20*a* may be provided for any of any number of cylinders (e.g., for a predetermined one of three cylinders, predetermined three of five cylinders, predetermined two of six cylinders, etc.), and the second swing member 20*b* may be provided for the other cylinder. The non-deactivation cylinder 6*a* and the deactivation cylinder 6*b* can therefore be selected as desired.

Second Modification

In the first to fourth embodiments, the control shaft 71 is not actively stopped at an intermediate position between the normal position P and the cylinder cutoff position Q. However, the control shaft 71 may be actively stopped at the intermediate position in the case where it is advantageous to stop the control shaft 71 at the intermediate position, etc.

Third Modification

In the first to fourth embodiments, the engagement hole 42 is a through hole formed in the slider gear 41. However, the engagement hole 42 may be a groove formed in the inner peripheral surface of the slider gear 41 so as to extend in the circumferential direction.

REFERENCE SIGNS LIST

1. Variable valve mechanism (first embodiment)
2. Variable valve mechanism (second embodiment)
3. Variable valve mechanism (third embodiment)
4. Variable valve mechanism (fourth embodiment)
6. Cylinder
6*a*. Non-deactivation cylinder (predetermined cylinder)
6*b*. Deactivation cylinder (cylinder other than predetermined cylinder)
8. Valve
10. Cam
20. Swing member
20*a*. First swing member
20*b*. Second swing member
21. Input member
31. Output member
41. Slider gear
70. Variable device
71. Control shaft
H. Helical spline
Ha. Helical spline of First swing member
Hb. Helical spline of Second swing member
P. Normal position
Q. Cylinder cutoff position

The invention claimed is:

1. A variable valve mechanism of an internal combustion engine, comprising:

a plurality of swing members arranged side by side in a linear direction, each including an input member, an output member, and a slider gear that meshes with the input member and the output member via helical splines, and each swinging to drive a valve by the output member when the input member is driven by a cam; and a variable device that includes a control shaft extending in the linear direction and being displaced in the linear direction together with the plurality of slider gears, and that displaces the control shaft in the linear direction to displace the plurality of slider gears at a time with respect to the plurality of input members and the plurality of output members, thereby changing valve lifts of the plurality of swing members at a time by meshing of the helical splines, wherein the swing members include a first swing member provided for a predetermined cylinder of a plurality of cylinders and a second swing member provided for a cylinder other than the predetermined cylinder of the plurality of cylinders, and a helix angle of the helical splines varies between the first swing member and the second swing member, and the variable device displaces the control shaft to a predetermined normal position to perform a normal operation in which both the first swing member and the second swing member drive the valve, and the variable device displaces the control shaft to a predetermined cylinder cutoff position to perform a cylinder cutoff operation in which the first swing member drives the valve and the second swing member does not drive the valve.

2. The variable valve mechanism of an internal combustion engine according to claim 1, wherein the helical splines of the first swing member are formed at such a helix angle that the valve lift of the first swing member decreases when the control shaft is displaced from the normal position to the cylinder cutoff position.

3. The variable valve mechanism of an internal combustion engine according to claim 2, wherein the variable device displaces the control shaft within the cylinder cutoff position to increase or decrease the valve lift of the first swing member while maintaining the cylinder cutoff operation.

4. The variable valve mechanism of an internal combustion engine according to claim 2, wherein the variable device does not increase or decrease the valve lift of the first swing member while maintaining the cylinder cutoff operation.

5. The variable valve mechanism of an internal combustion engine according to claim 2, wherein the variable device displaces the control shaft between the normal position and the cylinder cutoff position without stopping the control shaft at an intermediate position between the normal position and the cylinder cutoff position.

6. The variable valve mechanism of an internal combustion engine according to claim 1, wherein the helical splines of the first swing member are formed at such a helix angle that the valve lift of the first swing member increases when the control shaft is displaced from the normal position to the cylinder cutoff position.

7. The variable valve mechanism of an internal combustion engine according to claim 6, wherein the variable device displaces the control shaft within the cylinder cutoff position to increase or decrease the valve lift of the first swing member while maintaining the cylinder cutoff operation.

8. The variable valve mechanism of an internal combustion engine according to claim 6, wherein the variable device does not increase or decrease the valve lift of the first swing member while maintaining the cylinder cutoff operation.

9. The variable valve mechanism of an internal combustion engine according to claim 6, wherein the variable device displaces the control shaft between the normal position and the cylinder cutoff position without stopping the control shaft at an intermediate position between the normal position and the cylinder cutoff position.

10. The variable valve mechanism of an internal combustion engine according to claim 1, wherein the variable device displaces the control shaft within the cylinder cutoff position to increase or decrease the valve lift of the first swing member while maintaining the cylinder cutoff operation.

11. The variable valve mechanism of an internal combustion engine according to claim 1, wherein the variable device does not increase or decrease the valve lift of the first swing member while maintaining the cylinder cutoff operation.

12. The variable valve mechanism of an internal combustion engine according to claim 1, wherein the variable device displaces the control shaft between the normal position and the cylinder cutoff position without stopping the control shaft at an intermediate position between the normal position and the cylinder cutoff position.

* * * * *